US006729153B2

(12) United States Patent
Moon et al.

(10) Patent No.: US 6,729,153 B2
(45) Date of Patent: May 4, 2004

(54) INDOOR UNIT IN AIR CONDITIONER

(75) Inventors: Dong Soo Moon, Seoul (KR); Mun Kee Chung, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/198,110

(22) Filed: Jul. 19, 2002

(65) Prior Publication Data

US 2003/0145618 A1 Aug. 7, 2003

(30) Foreign Application Priority Data

Feb. 7, 2002 (KR) ..... P2002-7129

(51) Int. Cl.[7] ..... F25D 21/14
(52) U.S. Cl. ..... 62/285
(58) Field of Search ..... 62/262, 263, 285, 62/259.1, 419

(56) References Cited

U.S. PATENT DOCUMENTS 5,388,426 A * 2/1995 Wada et al. ..... 62/263
5,664,428 A * 9/1997 Sugiyama et al. ..... 62/259.1
6,336,338 B1 * 1/2002 Koren ..... 62/262

* cited by examiner

*Primary Examiner*—Denise L. Esquivel
*Assistant Examiner*—Malik N. Drake
(74) *Attorney, Agent, or Firm*—Birch, Stewart, Kolasch & Birch, LLP

(57) ABSTRACT

Disclosed is an indoor unit in an air conditioner of which components are arranged symmetrically so as to enable a compact design. The present invention includes a case having an intake port and a blow outlet, a blower installed inside a central part of the case along a length direction of the case, a heat exchanger installed between the intake port and blower so as to heat-exchange a room air which is sucked in, a fan motor coupled with one side of the blower so as to drive the blower, and a pipe part installed at a space opposite to the fan motor centering around the blower and connected between the heat exchanger an outdoor unit so that an operational fluid circulates through the pipe part.

14 Claims, 4 Drawing Sheets

INDOOR UNIT IN AIR CONDITIONER

This application claims the benefit of the Korean Application No. P2002-7129 filed on Feb. 7, 2002, which is hereby incorporated by reference.

BACKGROUND OF THE INVENTION

1. Field of the Invention

The present invention relates to an air conditioner, and more particularly, to an indoor unit in an air conditioner.

2. Discussion of the Related Art

Generally, an air conditioner is an appliance installed in a room of a store, office, home, and the like so as to cool or heat a room air.

Such air conditioners are mainly divided into an one body type of which parts constructing a cooling cycle are installed in one unit and a separative type constructed with two units for the cooling cycle. The separative type air conditioner includes an outdoor unit having a compressor and a condenser inside so as to compress and liquefy a refrigerant and an indoor unit having an evaporator and the like inside to evaporate the refrigerant so as to cool a room air.

A wall type air conditioner of the separative type hanging the indoor unit on the wall has an excellent use of space so as to be widely used.

FIG. 1A to FIG. 1C illustrate an indoor unit of a general wall type air conditioner.

Referring to FIG. 1A to FIG. 1C, an indoor unit in a wall type air conditioner includes a case 1 attached to a wall and having an intake port 1*a* at an upper part and a blow outlet 1*b* at a lower part, a blower installed at one side inside the case 1, a fan motor 3 coupled with one end of the blower 2 so as to rotate the blower 2, and a heat exchanger 4 installed between the intake port 1*a* and the blower 2.

And, an inlet pipe 5 guiding a refrigerant of an outdoor unit(not shown in the drawing) and an outlet pipe 6 are installed at one side of the heat exchanger 4.

Operation of the above-constructed indoor unit is schematically explained as follows. The blower 2 rotates in one direction by a power of the fan motor 3, and a turning force of the blower 2 inhales a room air through the intake port 1*a*. The inhaled air undergoes heat exchange through the heat exchanger 4, and then is blown into the room through the blow outlet 1*b* so as to cool the room.

Yet, the indoor unit in the wall type air conditioner has the following disadvantages or problems sue to its structural characteristics.

First, various components constructing the indoor unit are placed right and left to the case 1 asymmetrically, whereby it is, considerably difficult to design a product. Namely, as shown in FIG. 1B, the heat exchanger 4 is installed at a left side of the case 1, and the fan motor 3 and pipes 5 and 6 are installed at a right side of the case 1. In this case, the intake port 1*a* and the blow outlet 1*b* should be placed at some locations corresponding to the heat exchanger 4. Such conditions become limitations in designing a compact product as well as make an assembly work of the product difficult.

Second, since the inlet and outlet pipes 5 and 6 of the refrigerant are placed in the space accommodating the fan motor 3, a condensed water generated from surfaces of the pipes flows into electronic parts such as the fan motor 3 and the like. In this case, electric short of the fan motor 3 and the like become fatal to a reliance of the product.

Third, as the blow outlet 1*b* is formed at the lower part of the case 1, a flow direction of the blown air faces downward. In order to supply heating/cooling airflow evenly, the indoor unit has to be hung on an upper part of the wall. This makes many limitations on selecting the installing site of the indoor unit.

Fourth, as the intake port 1*a* is formed at the upper part of the case 1, particles in air are easily accumulated on the intake port 1*a* so as to flow in the case 1 easily. In order to prevent such an inflow, an additional particle remover should be installed at the intake port 1*a*.

SUMMARY OF THE INVENTION

Accordingly, the present invention is directed to an indoor unit in an air conditioner that substantially obviates one or more problems due to limitations and disadvantages of the related art.

An object of the present invention is to provide an indoor unit in an air conditioner of which components are arranged symmetrically so as to enable a compact design.

Another object of the present invention is to provide an indoor unit in an air conditioner enabling to increase a reliance.

A further object of the present invention is to provide an indoor unit in an air conditioner free from the limitation of installing location.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, an indoor unit in an air conditioner according to the present invention includes a case having an intake port and a blow outlet, a blower installed inside a central part of the case along a length direction of the case, a heat exchanger installed between the intake port and blower so as to heat-exchange a room air which is sucked in, a fan motor coupled with one side of the blower so as to drive the blower, and a pipe part installed at a space opposite to the fan motor centering around the blower and connected between the heat exchanger an outdoor unit so that an operational fluid circulates through the pipe part.

Besides, the present invention provides the indoor unit in the air conditioner so that the case is symmetric to the heat exchanger by installing the heat exchanger at a central part along a length direction of the case.

Accordingly, the present invention enables to design the compact indoor unit in the air conditioner as various components are arranged symmetrically centering around the blower and heat exchanger. Moreover, the present invention enables to overcome the problem of electric short circuit of the fan motor due to the condensed water since the fan motor and pipe part are left apart centering around the blower.

Meanwhile, the present invention provides an air conditioner of which blow outlet is formed on an upper front of the case, thereby enabling to install the indoor unit more freely.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1A:
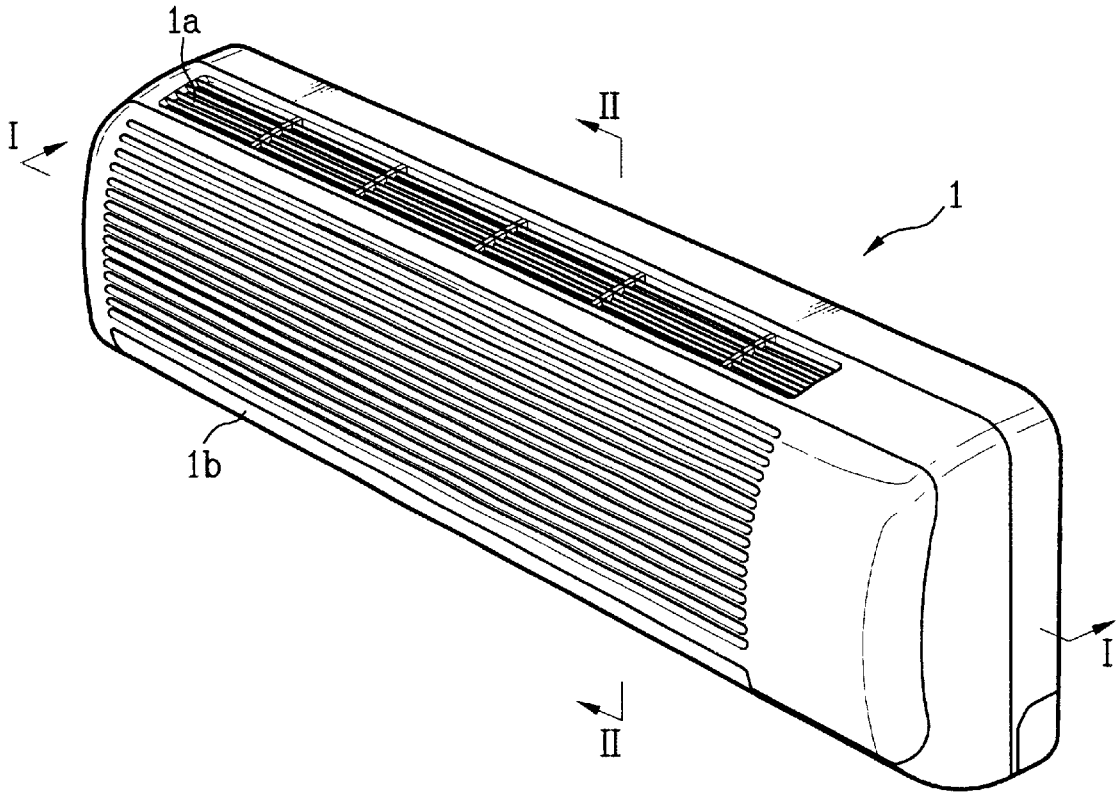
FIG.1A Related Art
FIG. 1A illustrates a bird's-eye view of an indoor unit in a general wall type air conditioner.
Figure 1B:
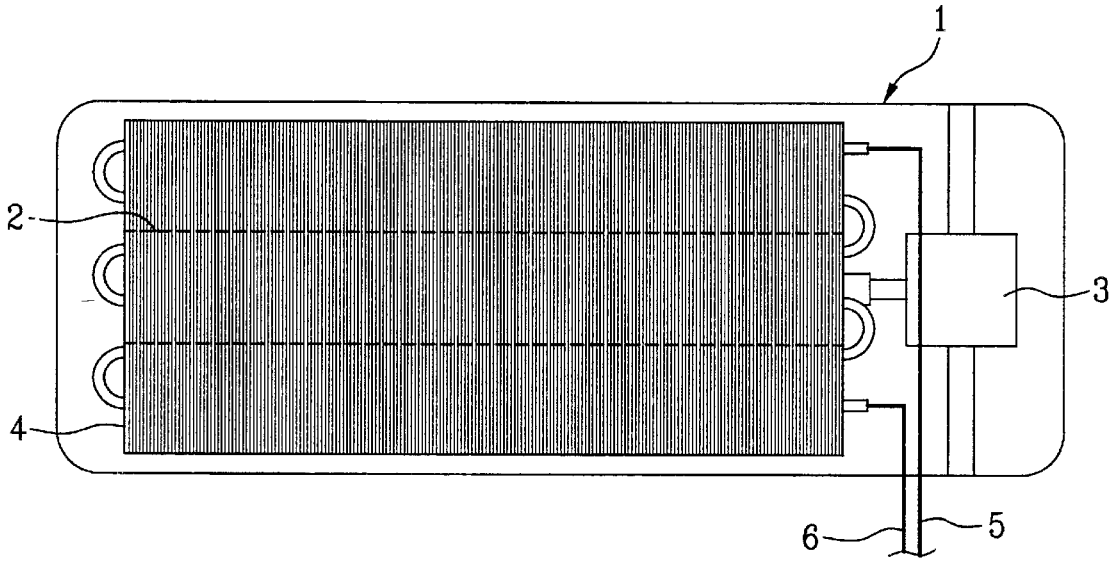
FIG.1B Related Art
FIG. 1B illustrates a cross-sectional view along a cutting line I—I in FIG. 1A.
Figure 1C:
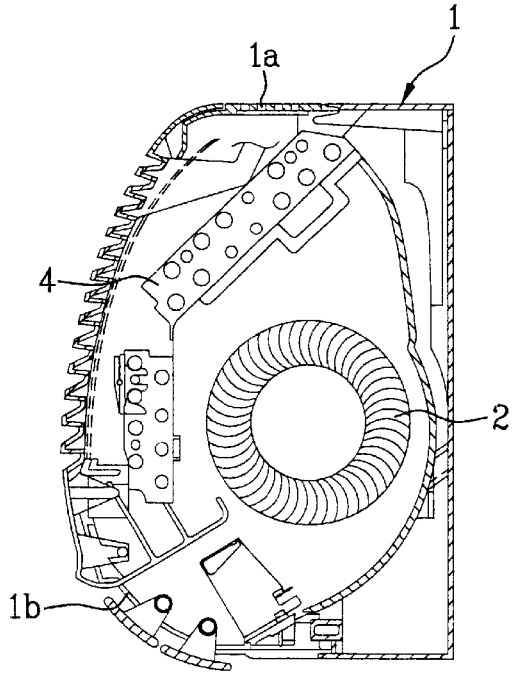
FIG.1C Related Art
FIG. 1C illustrates a cross-sectional view along a cutting line II—II in FIG. 1A.
Figure 2:
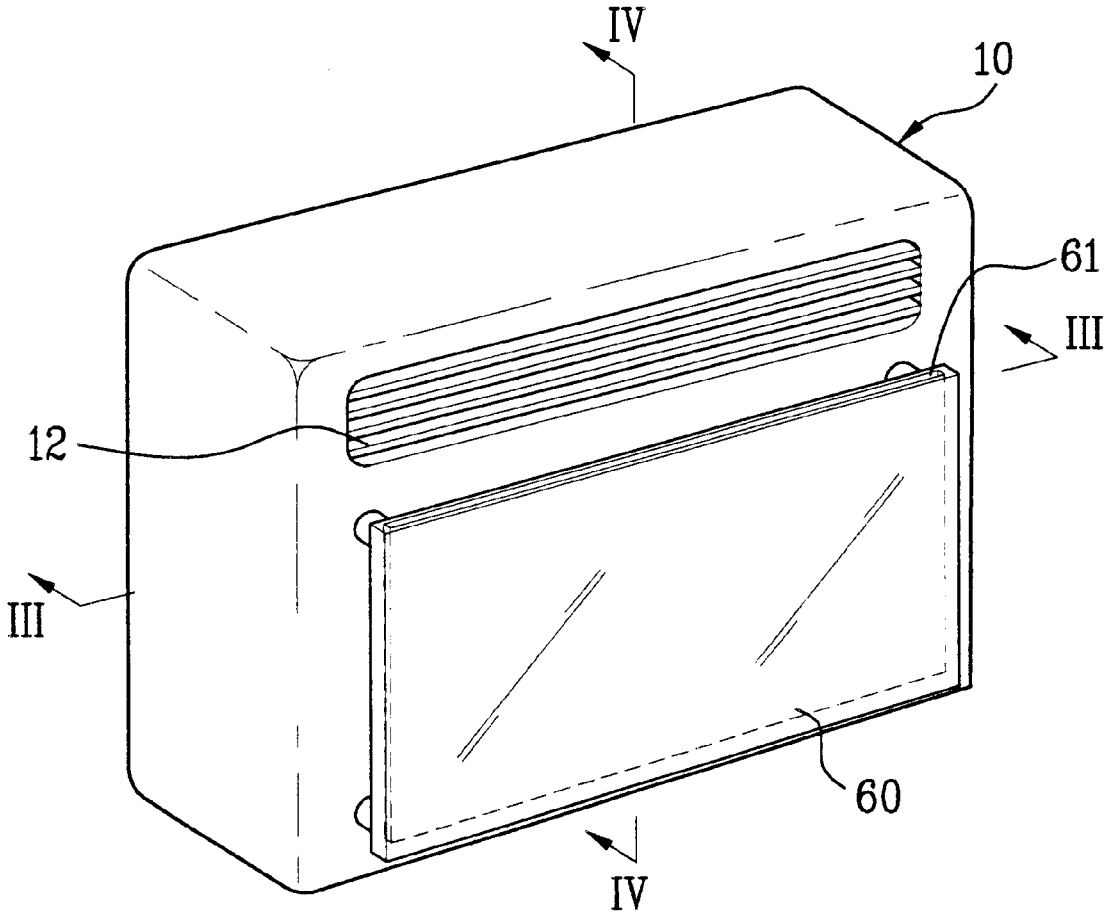
FIG. 2 illustrates a bird's-eye view of an indoor unit in an air conditioner according to the present invention.
Figure 3:
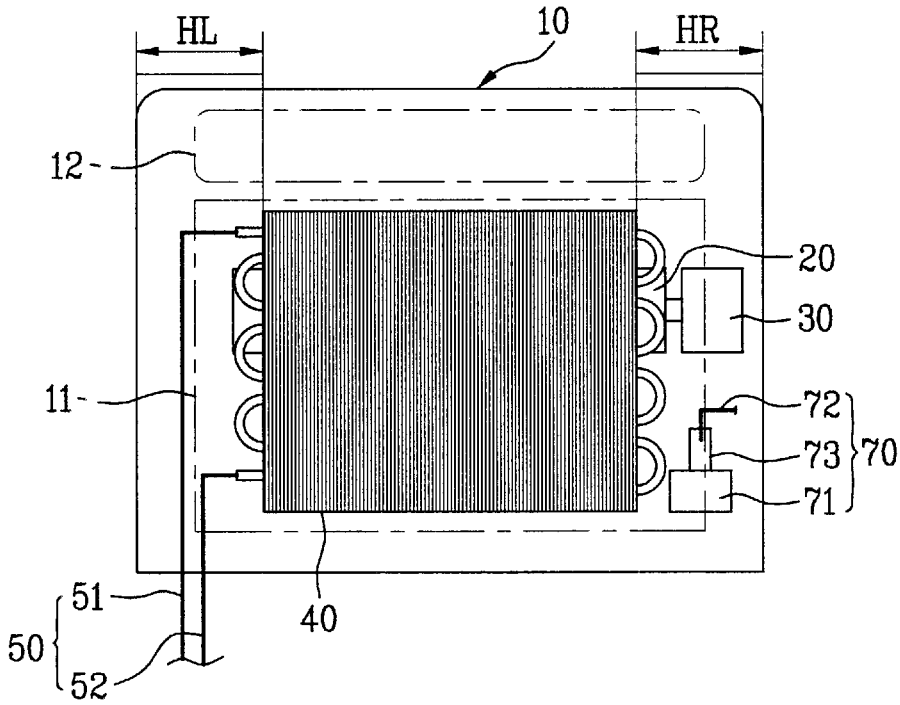
FIG. 3 illustrates a cross-sectional view along a cutting line III—III in FIG. 2.
Figure 4:
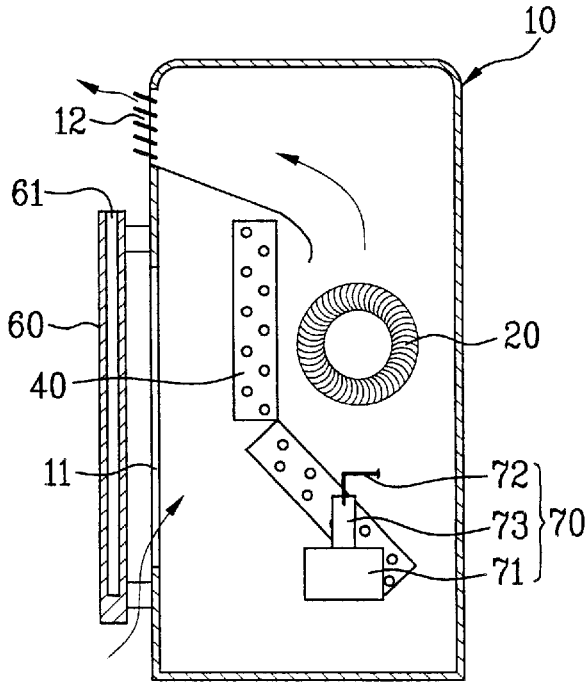
FIG. 4 illustrates a cross-sectional view along a cutting line IV—IV in FIG. 2.

FIG. 2 illustrates a bird's-eye view of an indoor unit in an air conditioner according to the present invention, FIG. 3 illustrates a cross-sectional view along a cutting line III—III in FIG. 2, and FIG. 4 illustrates a cross-sectional view along a cutting line IV—IV in FIG. 2.

Referring to FIG. 2 to FIG. 4, an indoor unit in an air conditioner according to the present invention includes a case 10 having an intake port 11 at a lower part and a blow outlet 12 at an upper part, a blower 20 installed inside the case 10 so as to circulate a room air forcibly, a heat exchanger 40 installed between the intake port 11 and blower 20 so as to heat-exchange the room air which is sucked in, a fan motor 30 coupled with one end of the blower 20 so as to drive the blower 20, and a pipe part 50 installed between the heat exchanger 40 and an outdoor unit(not shown in the drawing) so as to provide a flow path of an operational fluid.

A structure of the indoor unit in air conditioner according to the present invention is well shown in FIG. 3. Referring to FIG. 3, the blower 20 is installed inside a central part of the case 10 along a length direction of the case 10. This is to provide a right and left symmetry of the case 10 centering around the blower 20.

The pipe part 50 includes an inlet pipe 51 making the operational fluid flow in the heat exchanger 40 and an outlet pipe 52 discharging the operational fluid heat-exchanged by the heat exchanger 40. In this case, the pipe part 50 is installed in a space opposite to another space in which the fan motor 30 is installed centering around the blower 20, thereby enabling to protecting the fan motor 30 from a condensed water of the pipe part 50. Moreover, the fan motor 30 and pipe part 50 are installed at the right and left spaces of the blower 20 so as to use the right and left spaces of the case 10 more effectively.

The heat exchanger 40 like the blower 20 is installed inside a central part of the case along the length direction of the case 10. Specifically, a distance HR between one side of the case 10 and one side of the heat exchanger 40 are equal to that HL between the other sides of the case 10 and heat exchanger 40. This is also to provide the right and left symmetry of the case 10 centering around the heat exchanger 40. Therefore, the fan motor 30 and pipe part 50 are placed in both spaces confronting each other centering around the heat exchanger 40.

Meanwhile, a location of the heat exchanger 40 has an important influence on determining positions of the intake port 11 and blow outlet 12. This is because the heat exchanger 40 should be placed on a flow path of the room air circulating inside the case 10. Therefore, the intake port 11 and blow outlet 12 are preferably installed so as to be right and left symmetric along the length direction of the case 10 respectively.

In this case, the blow outlet 12 is formed on a front upper part of the case 10, while the intake port 11 is formed at a front lower part of the case 10, i.e. under the blow outlet 12. As the intake port 11 is formed at the front part of the case 10, it is able to prevent the floating particles from being accumulated on the intake port 11. Moreover, as the blow outlet 12 is formed at the front upper part of the case 10, a blowing direction of the heat-exchanged air is more free than that of the related art. Therefore, the installment place of the indoor unit according to the present invention can be chosen more freely. Of course, a wind direction control member(not shown in the drawing) or the like is preferably installed at the blow outlet 12.

Besides, a front panel 60 is installed at a front of the case 10 so as to cover the intake port 11. The front panel 60 prevents the intake port 11 from being directly exposed externally. In this case, the front panel 60 is left apart from the case 10 with a predetermined interval, whereby the room air can be sucked into through the intake port 11 smoothly. And, the front panel 60 is preferably installed at a central part of the case 10 in the length direction so as to be right and left symmetric along the length direction of the case 10.

Meanwhile, since the front panel 60 is directly exposed to a user, an insertion slot 61, as well shown in FIG. 4, is preferably formed in the front panel 60 so as to insert a picture or photo therein. In this case, a front part of the front panel 60 is made of a transparent material.

And, a condensed water handling means 70 is installed near one side of the blower 20, i.e. the space in which the fan motor 30 is installed so as to discharge the condensed water generated from the heat exchanger 40 outside the case 10. In this case, the condensed water handling means 70 is placed under the fan motor 30, and includes a sump 71 under the fan motor 30 so as to collect the condensed water generated from the heat exchanger 40 and a distributing pipe 72 of which one end is connected to the sump 71 and of which other end is exposed externally so as to guide the condensed water outside.

In this case, in order to discharge the condensed water of the sump 71 forcibly, a distributing pump 73 is preferably installed on the distributing pipe 72 so as to apply a pumping power thereto.

Meanwhile, as the intake ort 11 and blow outlet 12 are formed at the front of the case 10, a crossflow fan is preferably applied to the blower 20.

The above-constructed indoor unit in the air conditioner preferably has a capacity suitable for a standard quantity of human respiration, 0.1~0.15 l/s per person. In a general air conditioner according to the related art, a standard quantity of human respiration is 10 l/s per person so as to cool or heat the entire room, whereby the airflow provided by the appliance is unable to satisfy all the individual taste of persons in the room. Hence, it has been demanded that an indoor unit should be equipped with the capacity suitable for the air conditioning amount for human.

Meanwhile, the indoor unit in the air conditioner according to the present invention can be applied to a stand or ceiling type air conditioner as well as the wall type. In this case, the case 10 is installed so as to be detachable from a room wall or a room ceiling or portable on the room floor.

The above-constructed indoor unit in the air conditioner has the following effects or advantages.

First, the present invention enables to design the compact indoor unit in the air conditioner as various components are arranged symmetrically centering around the blower 20 and heat exchanger 40.

Second, the present invention enables to overcome the problem of electric short circuit of the fan motor 30 due to the condensed water since the fan motor 30 and pipe part 50 are left apart centering around the blower 20, thereby improving a reliance of product.

Third, the present invention provides an air conditioner of which blow outlet 12 is formed on an upper front of the case 10, thereby enabling to install the indoor unit more freely. And, the intake port 11 is formed at the front of the case 10 so as to reduce the inflow of particles.

It will be apparent to those skilled in the art than various modifications and variations can be made in the present invention. Thus, it is intended that the present invention covers the modifications and variations of this invention provided they come within the scope of the appended claims and their equivalents.

What is claimed is:

1. An indoor unit in an air conditioner, comprising:

a case having an intake port and a blow outlet, wherein the intake port and the blow outlet are installed along a length direction of the case so as to be symmetric right and left, respectively;

a blower installed inside a central part of the case along a length direction of the case;

a heat exchanger installed between the intake port and blower so as to heat-exchange a room air which is sucked in;

a fan motor coupled with one side of the blower so as to drive the blower; and a pipe part installed at a space opposite to the fan motor centering around the blower and connected between the heat exchanger an outdoor unit so that an operational fluid circulates through the pipe part.

2. The indoor unit of claim 1, wherein the heat exchanger is installed at the central part of the case along the length direction of the case so as to make the case symmetric right and left centering on the heat exchanger.

3. The indoor unit of claim 2, wherein the fan motor and pipe part are located at both sides confronting each other centering on the heat exchanger.

4. The indoor unit of claim 1, further comprising a condensed water handling means installed near one side of the blower so as to remove a condensed water generated from the heat exchanger.

5. The indoor unit of claim 4, the condensed water handling means comprising:

a sump under the fan motor so as to collect the condensed water; and a distributing pipe of which one end is connected to the sump and of which other end is exposed outside the case so as to guide the condensed water in the sump outside the case.

6. The indoor unit of claim 5, the condensed water handling means further comprising a distributing pump installed on the distributing pipe so as to discharge the condensed water in the sump forcibly.

7. The indoor unit of claim 1, wherein the blower is a crossflow fan.

8. An indoor unit in an air conditioner, comprising:

a case having an intake port and a blow outlet, wherein the blow outlet is formed at an upper front of the case and the intake port is formed below the blow outlet at a front of the case;

a blower installed inside a central part of the case along a length direction of the case;

a heat exchanger installed between the intake port and blower so as to heat-exchange a room air which is sucked in;

a fan motor coupled with one side of the blower so as to drive the blower; and a pipe part installed at a space opposite to the fan motor centering around the blower and connected between the heat exchanger an outdoor unit so that an operational fluid circulates through the pipe part.

9. The indoor unit of claim 8, further comprising a front panel installed at the front of the case to be left apart with a predetermined interval so as to cover the intake port.

10. The indoor unit of claim 9, wherein the front panel is installed along the length direction of the case so as to be symmetric right and left.

11. The indoor unit of claim 8, wherein an insertion slot is formed in the front panel so as to insert a picture or photo therein.

12. An indoor unit in an air conditioner, comprising:

a case having an intake port and a blow outlet, wherein the case is installed at a room floor so as to be portable;

a blower installed inside a central part of the case along a length direction of the case;

a heat exchanger installed between the intake port and blower so as to heat-exchange a room air which is sucked in;

a fan motor coupled with one side of the blower so as to drive the blower; and a pipe part installed at a space opposite to the fan motor centering around the blower and connected between the heat exchanger an outdoor unit so that an operational fluid circulates through the pipe part.

13. An indoor unit in an air conditioner, comprising:

a case having an intake port and a blow outlet, wherein the case is installed so as to be detachable from a wall;

a blower installed inside a central part of the case along a length direction of the case;

a heat exchanger installed between the intake port and blower so as to heat-exchange a room air which is sucked in;

a fan motor coupled with one side of the blower so as to drive the blower; and a pipe part installed at a space opposite to the fan motor centering around the blower and connected between the heat exchanger an outdoor unit so that an operational fluid circulates through the pipe part.

14. An indoor unit in an air conditioner, comprising:

a case having an intake port and a blow outlet, wherein the case is installed so as to be detachable from a ceiling;

a blower installed inside a central part of the case along a length direction of the case;

a heat exchanger installed between the intake port and blower so as to heat-exchange a room air which is sucked in;

a fan motor coupled with one side of the blower so as to drive the blower; and a pipe part installed at a space opposite to the fan motor centering around the blower and connected between the heat exchanger an outdoor unit so that an operational fluid circulates through the pipe part.

* * * * *